United States Patent [19]

Osborne et al.

[11] Patent Number: 5,022,352

[45] Date of Patent: Jun. 11, 1991

[54] BURNER FOR FORCED DRAFT CONTROLLED MIXTURE HEATING SYSTEM USING A CLOSED COMBUSTION CHAMBER

[75] Inventors: Robert E. Osborne, Gray; Tonie R. Frazier, Elizabethton, both of Tenn.

[73] Assignee: Mor-Flo Industries, Inc., Cleveland, Ohio

[21] Appl. No.: 531,060

[22] Filed: May 31, 1990

[51] Int. Cl.[5] ..... F22B 5/00

[52] U.S. Cl. ..... 122/17; 122/169; 431/329; 126/361; 239/553.3

[58] Field of Search ..... 122/169, 17; 431/328, 431/329; 126/361, 362; 239/553.3

[56] References Cited

U.S. PATENT DOCUMENTS

| | | | |
|---|---|---|---|
| 1,116,912 | 11/1914 | Parisen . | |
| 1,935,919 | 11/1933 | Ronstrom | 122/16 |
| 2,254,248 | 9/1941 | Stirlen | 126/43 |
| 2,368,356 | 1/1945 | Happe . | |
| 2,385,854 | 10/1945 | Wolfersperger | 158/99 |
| 2,799,288 | 7/1957 | Knight | 137/98 |
| 3,156,292 | 11/1964 | Ross . | |
| 3,199,572 | 8/1965 | Boulet | 158/116 |
| 3,204,683 | 9/1965 | Ruff et al. . | |
| 3,280,774 | 10/1966 | English . | |
| 3,291,187 | 12/1966 | Haensel | 431/329 |
| 3,324,924 | 6/1967 | Hailstone et al. . | |
| 3,445,175 | 5/1969 | Krieger | 431/328 |
| 3,601,320 | 8/1971 | Du Plessis | 239/542 |
| 3,741,710 | 6/1973 | Nelson | 431/90 |
| 3,759,230 | 9/1973 | Cooksley | 122/156 |
| 3,907,210 | 9/1975 | Dow, Jr. et al. | 239/553.3 |
| 3,923,446 | 12/1975 | Budden et al. | 431/114 |
| 4,140,100 | 2/1979 | Ishihara | 126/92 B |
| 4,204,832 | 5/1980 | Miller | 431/20 |
| 4,257,355 | 3/1981 | Cook | 122/17 |
| 4,303,042 | 12/1981 | Sumiyoshi | 122/17 |
| 4,336,820 | 6/1982 | Jorgensen et al. | 137/100 |
| 4,385,723 | 5/1983 | Sanborn et al. | 236/18 |
| 4,385,887 | 5/1983 | Yamamoto et al. | 431/90 |
| 4,445,464 | 5/1984 | Gerstmann et al. | 122/16 |
| 4,449,484 | 5/1984 | Sakamoto et al. | 122/13 R |
| 4,473,034 | 9/1984 | Raudabaugh et al. | 122/18 |
| 4,519,770 | 5/1985 | Kesselring et al. | 431/7 |
| 4,541,410 | 9/1985 | Jatana | 126/362 |
| 4,641,631 | 2/1987 | Jatana | 126/101 |
| 4,657,506 | 4/1987 | Ihlenfield et al. | 431/329 |
| 4,678,431 | 7/1987 | Widemann et al. | 431/328 |
| 4,723,513 | 2/1988 | Vallett et al. | 122/19 |
| 4,766,883 | 8/1988 | Cameron et al. | 126/351 |
| 4,793,800 | 12/1988 | Vallett et al. | 431/328 |

FOREIGN PATENT DOCUMENTS

| | | | |
|---|---|---|---|
| 0104586 | 9/1983 | European Pat. Off. . | |
| 0110071 | 10/1983 | European Pat. Off. . | |
| 2321663 | 3/1977 | France | 431/328 |
| 5324140 | 3/1978 | Japan . | |
| 1537239 | 12/1978 | United Kingdom . | |
| 1565310 | 4/1980 | United Kingdom . | |
| 2177493 | 1/1987 | United Kingdom . | |

OTHER PUBLICATIONS

"Negative Pressure Regulators (Zero Governors)", by Robert Shaw Controls, 2 pages, no date.

Honeywell Publication Form No. 68-0044-2, by Honeywell, Inc., 1984, 11 pages.

*Primary Examiner*—Carroll B. Dority

*Attorney, Agent, or Firm*—Body, Vickers & Daniels

[57] ABSTRACT

An improved fuel and air admixture burner for water heating and/or space heating appliances comprises concentrically arranged inner and outer sheet metal tubes closed at their top ends and the inner tube open at its bottom end through which a combustible fuel and air admixture is adapted to be introduced into the burner. The inner and outer tubes are specially configured to supply a balanced distribution of the combustible fuel and air admixture to the outer surface of the burner while allowing the heating apparatus to operate quietly. Perforations varying in size are distributed over a top zone, a middle zone, and a bottom zone of the inner tube, with the top and bottom zones containing larger perforations and the middle zone containing smaller perforations. The bottom zone is axially longer than the middle zone which in turn is axially longer than the top zone. The outer tube is formed of sheet metal resembling a very fine mesh screen having minute holes arranged in a straight pattern and having as many as 500 or more holes per square inch of surface area.

44 Claims, 3 Drawing Sheets

BURNER FOR FORCED DRAFT CONTROLLED MIXTURE HEATING SYSTEM USING A CLOSED COMBUSTION CHAMBER

The present invention pertains to the art of burners and more particularly to burners for water and space heating systems. The invention is particularly applicable to a burner for a combined water and space heating appliance and will be described with particular reference thereto although it will be appreciated that the invention has broader applications.

INCORPORATION BY REFERENCE

Cameron et al. U.S. Pat. No. 4,766,883 which issued Aug. 30, 1988 is incorporated herein by reference and is to be considered as forming part hereof.

BACKGROUND

Water heating and/or space heating appliances use heat created by a burner and transfer this heat to a fluid to be heated. One example of a high efficiency combined water and space heating appliance is described in U.S. Pat. No. 4,541,410 to Jatana. Jatana describes a heating apparatus in which air is mixed with fuel and introduced into a blower which moves the mixture under pressure into the burner in a closed combustion chamber. The combustion chamber is contained within a tank containing water. The products of combustion exit the combustion chamber and pass through a helical tube of several turns within the body of water. The heat of combustion is extracted through the walls of the combustion chamber and the helical exhaust tube. A high efficiency water heater results. The heated water from the water heater is also used to heat the air of a home or building by piping the hot water to a heat exchanger contained within the ducts of the home ventilation system.

The burner in the Jatana device is a cylindrically shaped screen contained within a cylindrical combustion chamber. It has been found that the introduction of the air and fuel mixture into this burner under pressure sometimes results in a swirling circumferential motion leading to noisy operation.

U.S. Pat. No. 4,766,883 to Cameron describes an improvement to Jatana U.S. Pat. No. 4,541,410 which maintains a desired air to fuel ratio regardless of changes in air inlet pressure. The heater uses a venturi type proportioner and an associated fuel regulator to provide an air and fuel mixture of constant ratio which is drawn from the proportioner by a blower and introduced into a closed combustion chamber for efficient burning and heating of a surrounding body of water.

The burner in the Cameron device, like that of the Jatana device, is a cylindrically shaped screen contained within a cylindrical combustion chamber. Contained within the burner screen is a burner divider comprised of three vertical plates radiating from the center of the burner to the surface of the burner screen. The burner divider is as tall as the burner itself and divides the interior volume of the burner into three wedge shaped sectors. In operation, the air and fuel mixture from a blower is forced through a burner distribution plate comprised of a thin sheet of stainless steel having a uniform pattern of holes therein into the interior volume of the burner. The burner distribution plate assures an even distribution of combustion gases. These gases flow upwardly through the sectors of the burner defined by the burner divider. The burner divider prevents the swirling of these combustion gases which might otherwise result in noisy operation but requires the addition of an extra part. This device provides a quietly efficient water and air heater, yet several problems persist.

The burner in the Cameron device exhibits unequal pressures on the burner screen, resulting in "hot spots", areas prone to failure due to carbonization. The Cameron burner also sometimes results in incomplete combustion.

The present invention contemplates a new and improved burner assembly which overcomes the above referred to problems and others and provides a burner of high efficiency, reliability, stability and quality.

SUMMARY OF THE INVENTION

In accordance with the present invention, there is provided a tubular burner for a heating apparatus including an inner tube and an outer tube. The inner tube includes an open end and large perforations distributed over the length of the tube whereby there is provided a uniform flow of combustion gases to the outer tube. The outer tube includes an open end and very small perforations over the length of the tube whereby there exists a balanced distribution of combustion gases on an outer wall surface of said outer tube.

Further in accordance with the present invention, the inner and outer tubes are of sheet metal construction.

Yet further in accordance with the invention, the inner tube has an axis and the outer tube has an axis, the axes of both tubes being positioned substantially vertically, the inner tube has a top end and a bottom end, the outer tube has a top end and a bottom end and the open ends of the inner and outer tubes are the bottom ends.

Yet further in accordance with the invention, the top ends of the inner and outer tubes are closed.

Still further in accordance with the invention, the inner and outer tubes are concentric.

Yet further in accordance with the invention, the large perforations distributed over the length of the inner tube vary in size.

Yet further in accordance with the invention, the perforations in the inner tube are distributed in a top zone, a middle zone and a bottom zone; the top and bottom zones contain larger perforations and the middle zone contains smaller perforations.

Still further in accordance with the invention, the bottom zone is longer than the middle zone and the middle zone is longer than the top zone.

Still further in accordance with the invention, the burner can be used as an integral part of a heating apparatus such as a water heater, a space heater, or a combination of the two. The burner is disposed within a combustion chamber receiving fuel and air through a combustion chamber inlet opening. Means for igniting a combustible mixture within the combustion chamber is provided.

The principal object of the present invention is the provision of a burner for a heating apparatus which burner has a long service life without the need for repair or replacement.

It is a further object of the present invention to provide a burner for a heating apparatus which supplies a balanced distribution of combustion gases to the outer surface of the burner.

It is a further object of the present invention to provide a burner that does not fail due to carbonization of isolated areas due to uneven distribution of combustion gases on the outer surface of the burner.

It is a further object of the present invention to provide cooler, more uniform and more complete combustion in a burner.

It is a further object of the present invention to provide improved burning and a better flame in a burner.

Still another object of the present invention is the provision of a burner that allows a heating apparatus to operate quietly.

It is a further object of the present invention to provide a burner that allows a heating apparatus to operate quietly without requiring the addition of an extra part to prevent swirling of combustion gases.

Still another object of the present invention is to provide a burner fabricated from sheet metal.

Yet another object of the present invention is to provide a burner that can be used as an integral part of a heating apparatus such as a water heater, space heater, or a combination of the two.

Further objects and advantages of the invention will become apparent from the following detailed description of the preferred embodiment of the invention and from the accompanying drawings.

BRIEF DESCRIPTION OF THE DRAWINGS

The invention may take physical form in certain parts and arrangements of parts, a preferred embodiment of which will be described in detail and illustrated in the accompanying drawings which form a part hereof and wherein.

DESCRIPTION OF THE PREFERRED EMBODIMENT

Figure 1:
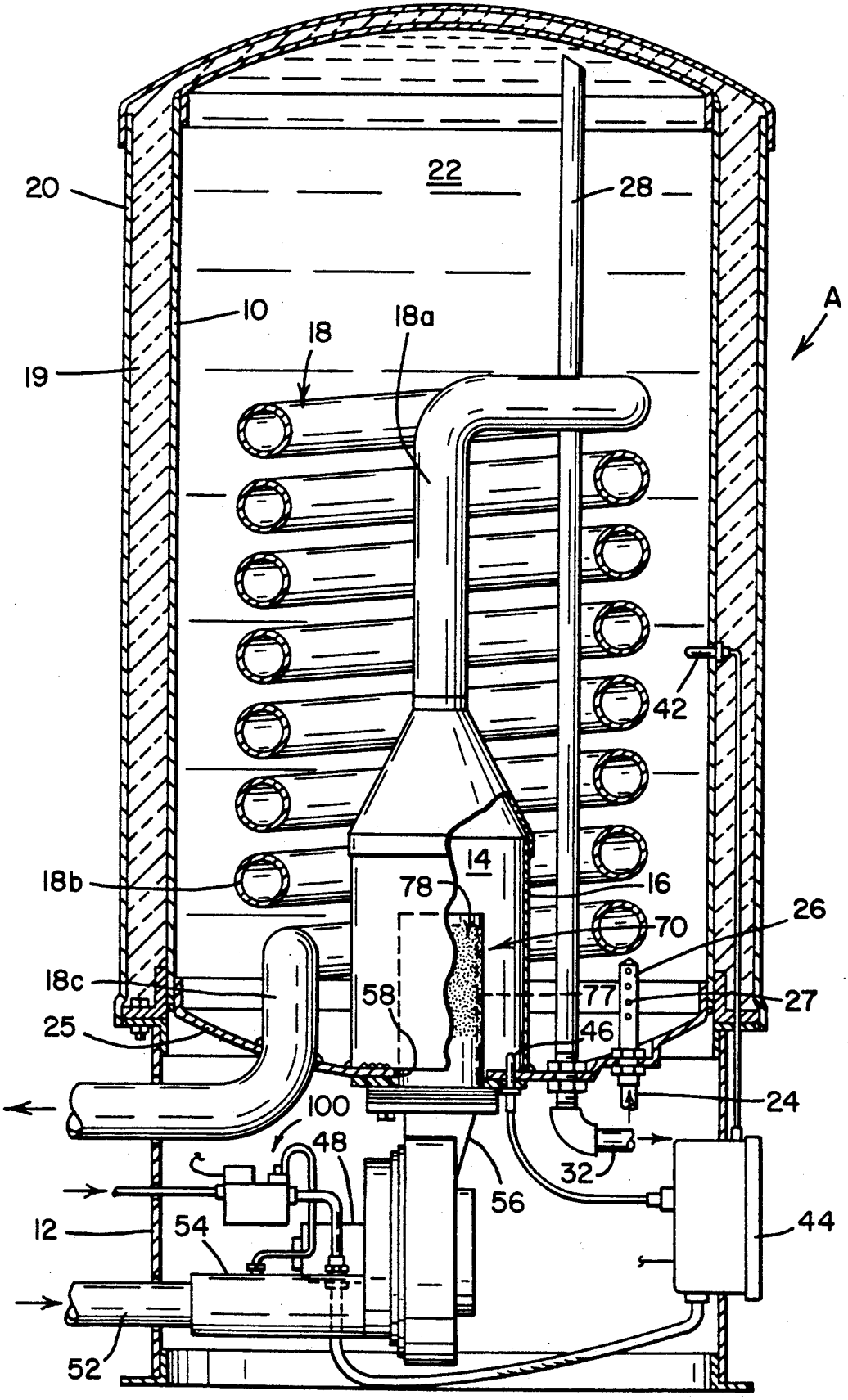
FIG. 1 is a side elevation of a combined water and air heater, in accordance with the present invention, partially broken away, showing the major elements of the heater.

Referring now to the drawings, wherein the showings are for the purposes of illustrating a preferred embodiment of the invention only and not for purposes of limiting same, the figures show a heater A comprised of a stainless steel water containing tank 10 supported upon a base 12 and containing a combustion chamber 14 surrounded by a combustion chamber wall 16 and an exhaust gas exit tube 18. The water containing tank 10 is surrounded by a layer of insulation 19 and a protective jacket 20 in the conventional manner.

The tank 10 is filled with a stratified body of water 22 with the coldest water remaining in the bottom of the tank and the hottest water rising to the top. The water to be heated is introduced into the water containing tank 10 through inlet piping 24 leading through the bottom plate 25 of the tank and feeding water to an inlet water diffuser 26. The diffuser 26 is a short, closed tube having apertures 27 along one of its side surfaces which introduces water into the tank 10 near its bottom.

Heated water is withdrawn from the tank 10 through an outlet tube 28 which is fixed to a fitting penetrating through the bottom plate 25 of the tank 10 and extends upwardly to the topmost region of the tank 10. The top of outlet tube 28 is open. Heated water passes through this opening into the tube, downwardly through the outlet tube, out of the tank 10 and into the outlet hot water piping 32.

Inlet piping 24 and outlet hot water piping 32 are connected to the domestic water piping of the building in which the heater is disposed thereby supplying hot water. The inlet piping 24 and outlet hot water piping 32 are also connected through appropriate valves to a heat exchanger in the space heating and ventilating system to provide heat for the building in accordance with the teachings of Jatana U.S. Pat. No. 4,451,410.

Heat is provided to the body of water 22 from the heat of fuel combustion in combustion chamber 14. The equipment and method of supplying combustion gases to the combustion chamber will be described below with reference to a system using natural gas as the input energy source. Other fuels, such as bottled propane gas, can be used with only slight adjustments to the system easily accomplished by those skilled in the art. Use of bottled gas in a system such as this is most appropriate in mobile home, camper and marine applications. Both the hot water for domestic use and the interior space heating in such a vehicle is provided by the single heater described herein.

When hot water is withdrawn from the water containing tank 10 through the outlet tube 28, additional cold water is drawn into the tank 10 through the inlet water diffuser 26. When sufficient cold water is drawn into the tank 10, the drop in water temperature is sensed by a water temperature sensor 42. The water temperature sensor 42 is connected to the electric control circuitry contained in an electrical control box 44. Appropriate control circuitry is well known in the art and will not be described in detail herein.

In response to the lowered water temperature within the tank 10, an electric ignitor 46 in combustion chamber 14 is turned on. The ignitor quickly reaches a temperature sufficiently high to ignite a gas and fuel mixture. A blower 48 is energized and a fuel regulator 100 is turned on. The blower 48 draws air from outside the building or vehicle through air inlet tubing 52 into an air and fuel proportioner 54 where fuel in introduced to the airstream and some mixing occurs. The air and fuel proportioner is described in detail hereafter. The air and fuel is drawn into the body of the blower 48 where it is pressurized and mixed further. A homogeneous air and fuel mixture results.

The blower 48 is a blower in which the air and fuel intake is near the center portion of the blower body and the output is on the outer periphery of the blower. This is important as all bearings and other points at which leaks may develop between the interior of the blower and the exterior of the blower are maintained at less than atmospheric pressure during blower operation. If a leak should develop through the failure of a seal, such a leak would result in a minor addition of air to the air and fuel mixture rather than fuel escaping from the blower.

The pressurized and homogenized air and fuel mixture from the blower 48 is directed through the output horn 56 of the blower 48 into the combustion chamber 14 through a combustion chamber inlet opening 58 in the tank bottom plate.

The Combustion Chamber

Figure 3:
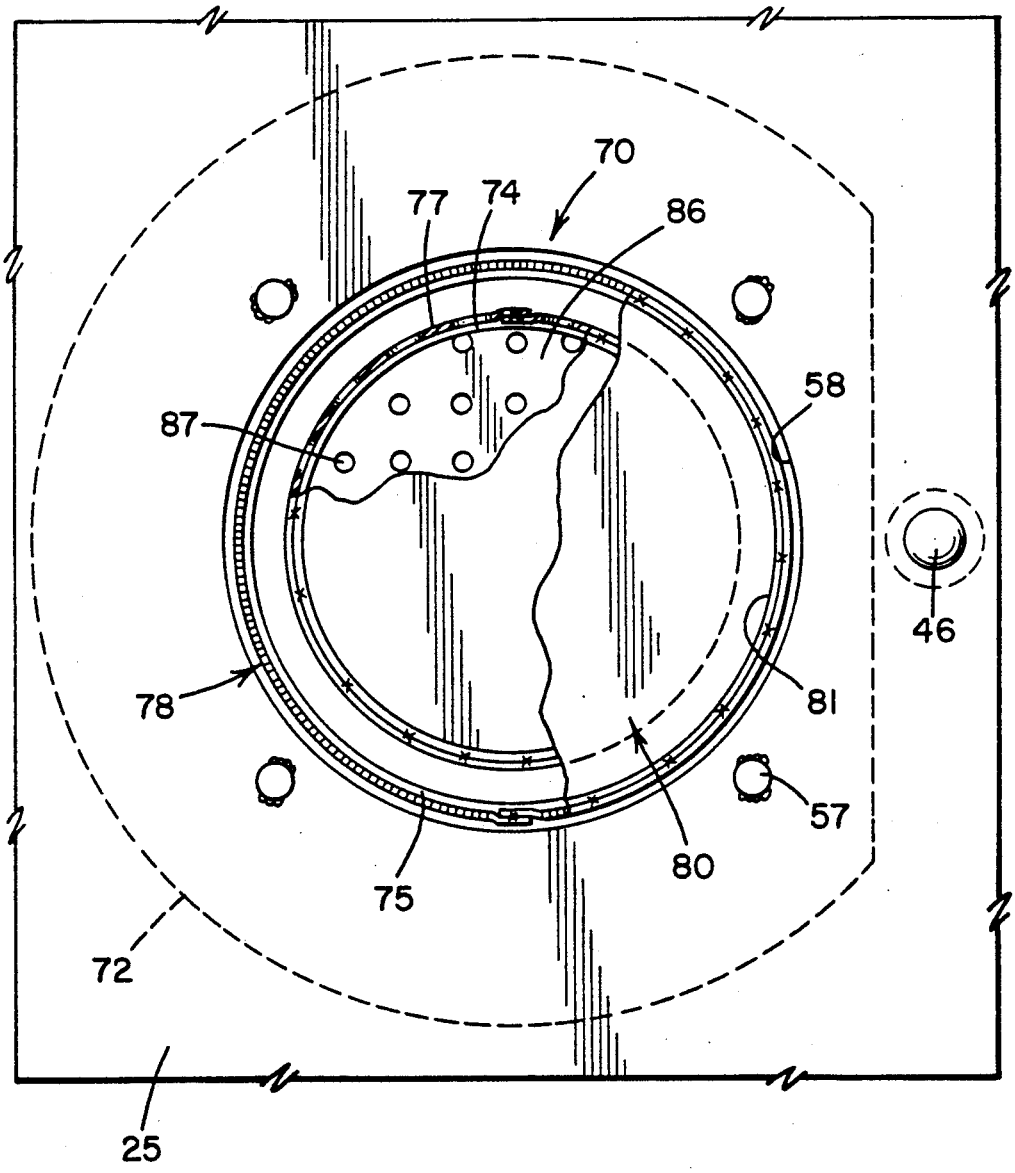
FIG. 3 is a cross-sectional view of the burner taken along line 3—3 in FIG. 2.

As can be best seen in FIG. 3, the blower output horn 56 is securely fastened to the tank bottom plate 25 by means of studs 57 passing through the flange of the output horn from the bottom plate 25. The blower output horn 56 is aligned with the combustion chamber inlet opening 58. The combustion chamber 14 is contained within a cylindrical combustion chamber wall 16 which is welded around its lower periphery to the bottom plate 25 of water containing tank 10. The top of the combustion chamber 14 is defined by a conical combustion chamber top 62 which is welded to the top of the combustion chamber wall 16. The combustion chamber top 62 is provided with an exhaust aperture 64 which communicates with the exhaust gas exit tube 18, only a portion of which is shown in FIG. 3. The exhaust gas exit tube 18 is welded to the topmost portion of the combustion chamber top 62. The exhaust gas exit tube 18 is comprised of a short vertical segment 18*a* leading upwardly from the combustion chamber and a helical segment 18*b* spiralling downwardly within the water containing tank 10. The lower end 18*c* of the exhaust gas exit tube exits the tank 10 through the tank bottom plate 25 and is connected to a duct removing exhaust gases from the structure being heated. Like water containing tank 10, the combustion chamber wall 16, the combustion chamber top 62 and the exhaust gas exit tube 18 are all fabricated from stainless steel.

The Burner

Figure 2:
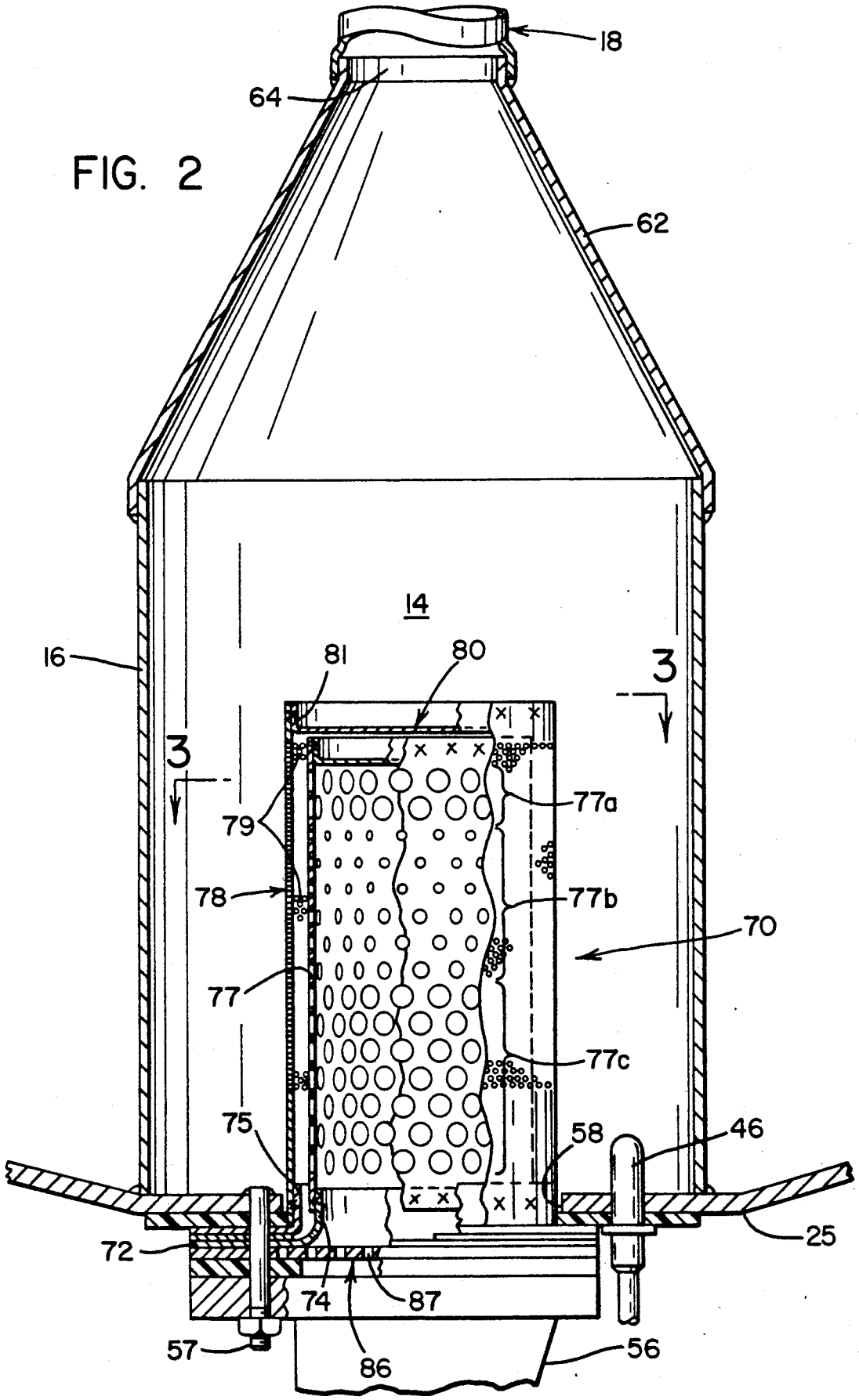
FIG. 2 is a side elevation of the combustion chamber and burner of a device shown in FIG. 1.

Up to this point the invention is the same as the water heater in Cameron et al. As best seen in FIG. 2, the burner 70 is contained within the lower portion of the combustion chamber 14 and is comprised of a burner mounting plate 72 disposed below the tank bottom plate 25, a cylindrical inner tube ring 74 which is welded to the mounting plate and which passes through the combustion chamber inlet opening 58, a cylindrical inner tube 77 which is welded to the top of the inner tube ring, a cylindrical outer tube 78 which is welded to an outer tube ring 75, an annular space between the tubes, and a burner end cap 80 which is welded to the top of said outer tube. The burner end cap is welded to the tops of both tubes in the preferred embodiment. By physically connecting the inner and outer tubes to the burner end cap, no mixing of different tube types, such as for LP gas on the one hand and natural gas on the other, can occur. Otherwise non-matching inner and outer tubes could be mistakenly installed into the same system. Perforations which vary in size are distributed over a top zone 77*a*, a middle zone 77*b* and a bottom zone 77*c* of the inner tube. The top and bottom zones contain larger perforations and the middle zone contains smaller perforations. Bottom zone 77*c* is axially longer than middle zone 77*b*, which is axially longer than top zone 77*a*. This design assures an even distribution of combustion gases will be provided to the outer tube. Outer tube 78 is sheet metal resembling a very fine mesh screen having 0.024 inch diameter holes 79 arrayed in a straight pattern resulting in 517 holes per square inch. The mesh is so fine that only 24% of the surface of the screen is actually open. Both tubes are formed from sheet metal with perforated holes although an alternative embodiment can be formed by stringing together metal wires to form the fine mesh screen. The burner end cap 80 is circular with a short cylindrical flange 81 depending from its periphery allowing welding of the cap to outer tube 78. A deflector, necessary in the prior art to ignite the flame, is not necessary with this invention because of the uniform flow pattern developed.

All of the elements of burner 70 are fabricated from stainless steel. Alternative embodiments of this invention could be fabricated from other materials. The burner is shown in a generally vertical position in the preferred embodiment but could be situated in other positions, such as horizontal, in alternative embodiments.

A burner distribution plate 86 comprised of a thin sheet of stainless steel having a uniform pattern of small holes 87 therein is disposed just below the burner mounting plate 72 at the interface between the burner 70 and the blower output horn 56. Appropriate gasketing is inserted in this stack of elements such that the burner 70, burner distribution plate 86 and the blower output horn 56 are firmly and airtightly fixed to the bottom plate 25 of the water containing tank 10.

In operation, the air and fuel mixture from blower 48 is forced through the burner distribution plate 86 into the interior volume of the inner tube 77 of the burner 70. The burner distribution plate 86 helps to assure an even distribution of combustion gases. These gases flow upwardly and are evenly distributed to the outer tube via the unique design of the inner tube. The even distribution of gases to the outer tube results in more uniform combustion than seen in the prior art. A problem in the prior art was failure of portions of a burner screen where concentrated, high temperature combustion occurred.

Uniform combustion allows for a longer service life of the burner since such hot spots are avoided. The use of two tubes in the burner avoids the noise problems seen in U.S. Pat. No. 4,541,410 to Jatana wherein the air and fuel mixture swirls within the burner. The use of two tubes avoids noise problems as effectively as U.S. Pat. No. 4,766,883 to Cameron et al. without the need of burner divider plates.

The combustion gases are forced through the very small openings in outer tube 78 where they are ignited by the existing flame front. The fine mesh of the outer tube prevents the migration of the flame front to the interior volume of the burner 70.

The heat of combustion generated outside of the outer tube 78 heats the combustion chamber wall 16 and combustion chamber top 62 and hence, the body of water 22 surrounding the combustion chamber 14. The hot products of combustion exit the combustion chamber 14 through the exhaust gas exit tube 18. As seen in FIG. 1, the exhaust gas exit tube 18 conveys the exhaust gases on a helically downwardly spiralling path through the body of water 22 and hence outside of the water containing tank 10 and outside of the building or vehicle in which the heater A is located. It must be remembered that blower 48 has pressurized the combustion gases, and hence the exhaust gases, allowing the exhaust gases to follow the convoluted and lengthy heat exchange path described above. Forced draft is applied: a natural draft is not required.

The exhaust gas exit tube 18 follows a counterclockwise downward spiral within tank 10. The apertures 27 in the inlet water diffuser 26 are orientated such that cool water entering the tank 10 flows in a clockwise direction. The cold water is first brought into contact with the lowest and coolest portion of the exhaust gas exit tube 18 and then spirals upwardly in a direction opposite to that of the exhaust gases in the exhaust gas exit tube. This forced counterflow brings the coldest water into contact with the coolest portion of the exhaust gas exit tube 18 and brings progressively warmer water against warmer portions of the exhaust gas exit tube 18. High efficiency heat exchange results.

The air and fuel proportioner and the system operation are the same as seen in U.S. Pat. No. 4,766,883 to Cameron et al. which is incorporated herein by reference.

The invention has been described with reference to a preferred embodiment. Obviously, modifications and alterations will occur to others upon the reading and understanding of this specification. It is our intention to include all such modifications and alterations insofar as they come within the scope of the appended claims or the equivalents thereof.

Having thus described the invention, it is claimed:

1. A tubular metal burner for a heating apparatus comprising an inner tube having an axis, a top end and a bottom end, and a concentric outer tube having an axis, a top end and a bottom end, said tube axes being substantially vertical;

said bottom end of said inner tube being open, said inner tube top end being closed and said inner tube having large perforations which vary in size distributed in a plurality of zones over the length of said inner tube and including middle zone containing smaller perforations than those in the others of said zones whereby there is provided a uniform flow of combustion gases to said outer tube; and said bottom end of said outer tube being open, said outer tube top being closed and said outer tube having very small perforations relative to the perforations in said inner tube over the length of said outer tube whereby there exists a balanced distribution of combustion gases on the surface of said outer tube.

2. The burner of claim 1 wherein said inner and outer tubes are of sheet metal construction.

3. A tubular metal burner for a heating apparatus comprising an inner tube having an axis, a top end and bottom end, and a concentric outer tube having an axis, a top end and a bottom end, said tube axes being substantially vertical;

said bottom end of said inner tube being open, said inner tube top end being closed and said inner tube having large perforations which vary in size distributed over the length of said inner tube, said perforations in said inner tube being distributed in a top zone, a middle zone, and a bottom zone, said top and bottom zones containing larger perforations and said middle zone containing smaller perforations whereby there is provided a uniform flow of combustion gases to said outer tube, and said bottom end of said outer tube being open, said outer tube top being closed and said outer tube having very small perforations relative to the perforations in said inner tube over the length of said outer tube whereby there exists a balanced distribution of combustion gases on the surface of said outer tube.

4. The burner of claim 3 wherein said bottom zone is longer than said middle zone and said middle zone is longer than said top zone.

5. The burner of claim 1 wherein said perforations in said inner tube vary in diameter from 3/16 inch to ⅛ inch.

6. The burner of claim 1 wherein said perforations in said outer tube have a diameter of about 0.024 inch.

7. A tubular burner for a heating apparatus comprising an inner tube and an outer tube, said inner tube including an open end and large perforations which vary in size distributed in a plurality of zones over the length of the said inner tube and including a middle zone containing smaller perforations than in the others of said zones whereby there is provided a uniform flow of combustion gases to said outer tube, said outer tube including an open end and very small perforations relative to the perforations in said inner tube over the length of the tube whereby there exists a balanced distribution of combustion gases on an outer wall surface of said outer tube.

8. The burner of claim 7 wherein said inner and outer tubes are of sheet metal construction.

9. The burner of claim 7 wherein said inner tube has an axis and said outer tube has an axis, said axes positioned substantially vertically, said inner tube has a top end and a bottom end, said outer tube has a top end and a bottom end and said open ends of said inner and outer tubes are said bottom ends.

10. The burner of claim 7 wherein said inner and outer tubes are concentric.

11. A tubular burner for a heating apparatus comprising an inner tube and an outer tube, said inner tube including an open end and large perforations distributed over the length of the said inner tube, said perforations in said inner tube being distributed in a top zone, a middle zone and a bottom zone, said top and bottom zones containing larger perforations and said middle zone containing smaller perforations whereby there is provided a uniform flow of combustion gases to said outer tube, said outer tube including an open end and very small perforations relative to the perforations in said inner tube over the length of the tube whereby there exists a balanced distribution of combustion gases on an outer wall surface of said outer tube.

12. The burner of claim 11 wherein said bottom zone is longer than said middle zone and said middle zone is longer than said top zone.

13. The burner of claim 7 wherein said perforations in said inner tube vary in diameter from 3/16 inch to ⅛ inch.

14. The burner of claim 7 wherein said perforations in said outer tube have a diameter of about 0.024 inch.

15. A heating apparatus comprising:

a tank adapted to contain a body of fluid to be heated;

a sealed combustion chamber disposed within said tank having an inlet opening and an exhaust aperture;

an exhaust gas exit tube connected to said exhaust aperture and exiting said tank;

a tubular burner disposed within said combustion chamber receiving a combustible mixture of fuel and air through said combustion chamber inlet opening, said tubular burner comprising an inner tube and an outer tube, said inner tube including an open end and large perforations which vary in size distributed in a plurality of zones over the length of the said inner tube and including a middle zone containing smaller perforations than those in the others of said zones whereby there is provided a uniform flow of combustion gases to said outer tube, said outer tube including an open end and very small perforations relative to the perforations in said inner tube over the length of the tube whereby there exists a balanced distribution of combustion gases on an outer wall surface of said outer tube;

an airtight fluid moving means having an output fixed to said combustion chamber inlet opening and having an inlet;

and an air and fuel proportioner having an air inlet section in flow communication with a source of air, a fuel inlet and an outlet fixed to said fluid moving means inlet whereby a stream of air and a stream of fuel are drawn at less than standard atmospheric pressure through said air and fuel proportioner in response to operation of said fluid moving means;

said air-tight fluid moving means effective to mix said air and fuel into a combustible mixture away from said proportioner and direct said mixture at pressure above standard atmosphere into said burner.

16. The burner of claim 15 wherein said inner and outer tubes are of sheet metal construction.

17. The burner of claim 15 wherein said inner and outer tubes have main axes and bottoms, said axes are substantially vertical, and said open ends of said inner and outer tubes are located at said bottoms of said tubes.

18. The burner of claim 17 wherein said tubes have closed top ends.

19. The burner of claim 15 wherein said inner and outer tubes are concentric.

20. The burner of claim 15 wherein said perforations in said inner tube vary in diameter from 3/16 inch to ⅛ inch.

21. A heating apparatus comprising:

a tank adapted to contain a body of fluid to be heated;

a sealed combustion chamber disposed within said tank having an inlet opening and an exhaust aperture;

an exhaust gas exit tube connected to said exhaust aperture and exiting said tank;

a tubular burner disposed within said combustion chamber for receiving a combustible mixture of fuel and air through said combustion chamber inlet opening, said tubular burner comprising an inner tube and an outer tube, said inner tube including an open end and large perforations distributed over the length of said inner tube, said perforations in said inner tube being distributed in a top zone, a middle zone and a bottom zone, said top and bottom zones containing larger perforations and said middle zone containing smaller perforations whereby there is provided a uniform flow of combustion gases to said outer tube, said outer tube including an open end and very small perforations relative to the perforations in said inner tube over the length of the tube whereby there exists a balanced distribution of combustion gases on an outer wall surface of said outer tube;

an airtight fluid moving means having an output fixed to said combustion chamber inlet opening and having an inlet;

and an air and fuel proportioner having an air inlet section in flow communication with a source of air, a fuel inlet and an outlet fixed to said fluid moving means inlet whereby a stream of air and a stream of fuel are drawn at less than standard atmospheric pressure through said air and fuel proportioner in response to operation of said fluid moving means;

said airtight fluid moving means effective to mix said air and fuel into a combustible mixture away from said proportioner and direct said mixture at pressure above standard atmospheric pressure into said burner.

22. The burner of claim 21 wherein said bottom zone is longer than said middle zone and said middle zone is longer than said top zone.

23. The burner of claim 15 wherein said perforations in said outer tube have a diameter of about 0.024 inch.

24. A heating apparatus comprising:

a tank adapted to contain a body of fluid to be heated;

a sealed combustion chamber disposed within said tank having an inlet opening and an exhaust aperture;

an exhaust gas exit tube connected to said exhaust aperture and exiting said tank;

a tubular metal burner disposed within said combustion chamber for receiving a combustible mixture of fuel and air through said combustion chamber inlet opening, said tubular burner comprising an inner tube having an axis, a top end and bottom end and a concentric outer tube having an axis, a top end and a bottom end, said tubes having their axes being positioned substantially vertically, said bottom end of said inner tube being open, said top end being closed and large perforations which vary in size distributed in a plurality of zones over the length of said inner tube and including a middle zone containing smaller perforations than those in the others of said zones whereby there is provided a uniform flow of combustion gases to said outer tube, said bottom end of said outer tube being open, said top end being closed and said outer tube including very small perforations relative to the perforations in said inner tube over the length of the tube whereby there exists a balanced distribution of combustion gases on the outer wall surface of said outer tube, and means for igniting said combustible mixture within said combustion chamber;

an airtight fluid moving means having an output fixed to said combustion chamber inlet opening and having an inlet;

and an air and fuel proportioner having an air inlet section in flow communication with a source of air, a fuel inlet and an outlet fixed to said fluid moving means inlet whereby a stream of air and a stream of fuel are drawn at less than standard atmospheric pressure through said air and fuel proportioner in response to operation of said fluid moving means;

said air-tight fluid moving means effective to mix said air and fuel into a combustible mixture away from said proportioner and direct said mixture at pressure above standard atmospheric pressure into said burner.

25. The burner of claim 24 wherein said inner and outer tubes are of sheet metal construction.

26. The burner of claim 24 wherein said perforations in said inner tube vary in diameter from 3/16 inch to ⅛ inch.

27. A heating apparatus comprising:

a tank adapted to contain a body of fluid to be heated;

a sealed combustion chamber disposed within said tank having an inlet opening and an exhaust aperture;

an exhaust gas exit tube connected to said exhaust aperture and exiting said tank;

a tubular metal burner disposed within said combustion chamber for receiving a combustible mixture of fuel and air through said combustion chamber inlet opening, said burner comprising an inner tube having an axis, a top end and a bottom end and a concentric outer tube having an axis, a top end and a bottom end, said tubes having their axes being positioned substantially vertically, said bottom end of said inner tube being open, said top being closed and large perforations which vary in size distributed over the length of said inner tube, said perforations in said inner tube being distributed in a top zone, a middle zone and a bottom zone, said top and bottom zones containing larger perforations and said middle zone containing smaller perforations whereby there is provided a uniform flow of combustion gases to said outer tube, said bottom end of said outer tube being open, said top end being closed and said outer tube including very small perforations relative to the perforations in said inner tube over the length of the tube whereby there exists a balanced distribution of combustion gases on the outer wall surface of said outer tube, and means for igniting said combustible mixture within said combustion chamber;

an airtight fluid moving means having an output fixed to said combustion chamber inlet opening and having an inlet;

and an air and fuel proportioner having an air inlet section in flow communication with a source of air, a fuel inlet and an outlet fixed to said fluid moving means inlet whereby a stream of air and a stream of fuel are drawn at less than standard atmospheric pressure through said air and fuel proportioner in response to operation of said fluid moving means;

said airtight fluid moving means effective to mix said air and fuel into a combustible mixture away from said proportioner and direct said mixture at pressure above standard atmospheric pressure into said burner.

28. The burner of claim 27 wherein said bottom zone is longer than said middle zone and said middle zone is longer than said top zone.

29. The burner of claim 24 wherein said perforations in said outer tube have a diameter of about 0.024 inch.

30. A heating apparatus comprising:

a tank adapted to contain a body of fluid to be heated;

a sealed combustion chamber disposed within said tank having an inlet opening and an exhaust aperture;

an exhaust gas exit tube connected to said exhaust aperture and exiting said tank;

a burner disposed within said combustion chamber for receiving fuel and air through said combustion chamber inlet opening;

an airtight fluid moving means having an output fixed to said combustion chamber inlet opening and having an inlet;

an air and fuel proportioner having an air inlet section in flow communication with a source of air, a fuel inlet and an outlet fixed to said fluid moving means inlet whereby a stream of air and a stream of fuel are drawn at less than standard atmospheric pressure through said air and fuel proportioner in response to operation of said fluid moving means;

said air-tight fluid moving means effective to mix said air and fuel into a combustible mixture away from said proportioner and direct said mixture at pressure above standard atmospheric pressure into said burner;

the improvement comprising:

said burner being tubular and comprising an inner tube and an outer tube, said inner tube including an open end and large perforations which vary in size distributed in a plurality of zones over the length of the said inner tube and including a middle zone containing smaller perforations than those in the others of said zones whereby there is provided a uniform flow of combustion gases to the outer surface of said outer tube, said outer tube including an open end and very small perforations relative to the perforations in said inner tube over the length of the tube whereby there exists a balanced distribution of combustion gases on an outer wall surface of said outer tube.

31. The burner of claim 30 wherein said inner and outer tubes are of sheet metal construction.

32. The burner of claim 30 wherein said inner and outer tubes have main axes and bottoms, said axes are substantially vertical, said open ends of said inner and outer tubes are located at said bottoms of said tubes.

33. The burner of claim 30 wherein said tubes have closed top ends.

34. The burner of claim 30 wherein said inner and outer tubes are concentric.

35. The burner of claim 30 wherein said perforations in said inner tube vary in diameter from 3/16 inch to ⅛ inch.

36. A heating apparatus comprising:

a tank adapted to contain a body of fluid to be heated;

a sealed combustion chamber disposed within said tank having an inlet opening and an exhaust aperture;

an exhaust gas exit tube connected to said exhaust aperture and exiting said tank;

a burner disposed within said combustion chamber for receiving fuel and air through said combustion chamber inlet opening;

an airtight fluid moving means having an output fixed to said combustion chamber inlet opening and having an inlet;

an air and fuel proportioner having an air inlet section in flow communication with a source of air, a fuel inlet and an outlet fixed to said fluid moving means inlet whereby a stream of air and a stream of fuel are drawn at less than standard atmospheric pressure through said air and fuel proportioner in response to operation of said fluid moving means;

said airtight fluid moving means effective to mix said air and fuel into a combustible mixture away from said proportioner and direct said mixture at pressure above standard atmospheric pressure into said burner;

the improvement comprising:

said burner being tubular and comprising an inner tube and an outer tube, said inner tube including an open end and being provided with large perforations distributed over the length of the said inner tube, said perforations in said inner tube being distributed in a top zone, a middle zone and a bottom zone, said top and bottom zones containing larger perforations and said middle zone containing smaller perforations whereby there is provided a uniform flow of combustion gases to the outer surface of said outer tube, said outer tube including an open end and very small perforations relative to the perforations in said inner tube over the length of the tube whereby there exists a balanced distribution of combustion gases on an outer wall surface of said outer tube.

37. The burner of claim 36 wherein said bottom zone is longer than said middle zone and said middle zone is longer than said top zone.

38. The burner of claim 30 wherein said perforations in said outer tube have a diameter of about 0.024 inch.

39. A heating apparatus comprising:

a tank adapted to contain a body of fluid to be heated;

a sealed combustion chamber disposed within said tank having an inlet opening and an exhaust aperture;

an exhaust gas exit tube connected to said exhaust aperture and exiting said tank;

a burner disposed within said combustion chamber for receiving fuel and air through said combustion chamber inlet opening, and means for igniting said combustible mixture within said combustion chamber;

an airtight fluid moving means having an output fixed to said combustion chamber inlet opening and having an inlet;

an air and fuel proportioner having an air inlet section in flow communication with a source of air, a fuel inlet and an outlet fixed to said fluid moving means inlet whereby a stream of air and a stream of fuel are drawn at less than standard atmospheric pressure through said air and fuel proportioner in response to operation of said fluid moving means;

said airtight fluid moving means effective to mix said air and fuel into a combustible mixture away from said proportioner and direct said mixture at pressure above standard atmospheric pressure into said burner;

the improvement comprising:

said burner being tubular and comprising an inner tube having an axis, a top end and a bottom end and a concentric outer tube having an axis, a top end and a bottom end, said tubes having their axes being positioned substantially vertically, said bottom end of said inner tube being open, said top end being closed and large perforations which vary in size distributed in a plurality of zones over the length of said inner tube and including a middle zone containing smaller perforations than those in the others of said zones whereby there is provided a uniform flow of combustion gases to said outer tube, said bottom end of said outer tube being open, said top end being closed and said outer tube including very small perforations relative to the perforations in said inner tube over the length of the tube whereby there exists a balanced distribution of combustion gases on the outer wall surface of said outer tube.

40. The burner of claim 39 wherein said inner and outer tubes are of sheet metal construction.

41. The burner of claim 39 wherein said perforations in said inner tube vary in diameter from 3/16 inch to ⅛ inch.

42. A heating apparatus comprising:

a tank adapted to contain a body of fluid to be heated;

a sealed combustion chamber disposed within said tank having an inlet opening and an exhaust aperture;

an exhaust gas exit tube connected to said exhaust aperture and exiting said tank;

a burner disposed within said combustion chamber for receiving fuel and air through said combustion chamber inlet opening, and means for igniting said combustible mixture within said combustion chamber;

an airtight fluid moving means having an output fixed to said combustion chamber inlet opening and having an inlet;

an air and fuel proportioner having an air inlet section in flow communication with a source of air, a fuel inlet and an outlet fixed to said fluid moving means inlet whereby a stream of air and a stream of fuel are drawn at less than standard atmospheric pressure through said air and fuel proportioner in response to operation of said fluid moving means;

said airtight fluid moving means effective to mix said air and fuel into a combustible mixture away from said proportioner and direct said mixture at pressure above standard atmospheric pressure into said burner;

the improvement comprising:

said burner being tubular and comprising an inner tube having an axis, a top end and a bottom end and a concentric outer tube having an axis, a top end and a bottom end, said tubes having their axes being positioned substantially vertically, said bottom end of said inner tube being open, said top end being closed and large perforations which vary in size distributed over the length of said inner tube whereby there is provided a uniform flow of combustion gases to said outer tube, said perforations in said inner tube being distributed in a top zone, a middle zone and a bottom zone, said top and bottom zones containing larger perforations and said middle zone containing smaller perforations, said bottom end of said outer tube being open, said top end being closed and said outer tube including very small perforations relative to the perforations in said inner tube over the length of the tube whereby there exists a balanced distribution of combustion gases on the outer wall surface of said outer tube.

43. The burner of claim 42 wherein said bottom zone is longer than said middle zone and said middle zone is larger than said top zone.

44. The burner of claim 39 wherein said perforations in said outer tube have a diameter of about 0.024 inch.

* * * * *

UNITED STATES PATENT OFFICE

CERTIFICATE OF CORRECTION

Patent No. 5,022,352 Dated June 11, 1991

Inventor(s) Robert E. Osborne; Tonie R. Frazier

It is certified that error appears in the above-identified patent and that said Letters Patent is hereby corrected as shown below:

Column 4, line 64, "3" should read -- 2 --. Column 5, line 10, "3" should read -- 2 --; line 61, "depending" should read --- upstanding ---. Column 11, line 3, (claim 27, line 16), after "top" insert -- end --.

Signed and Sealed this

Sixteenth Day of March, 1993

*Attest:*

STEPHEN G. KUNIN

*Attesting Officer*

*Acting Commissioner of Patents and Trademarks*